US008001982B2

(12) United States Patent
Guillot

(10) Patent No.: US 8,001,982 B2
(45) Date of Patent: Aug. 23, 2011

(54) MAKEUP COMPACT

(75) Inventor: Jean-Claude Guillot, Verrieres le Buisson (FR)

(73) Assignee: L'Oreal, Paris (FR)

( * ) Notice: Subject to any disclaimer, the term of this patent is extended or adjusted under 35 U.S.C. 154(b) by 569 days.

(21) Appl. No.: 12/153,428

(22) Filed: May 19, 2008

(65) Prior Publication Data

US 2008/0289645 A1 Nov. 27, 2008

Related U.S. Application Data

(60) Provisional application No. 60/944,841, filed on Jun. 19, 2007.

(30) Foreign Application Priority Data

May 22, 2007 (FR) ..... 07 55188
May 25, 2007 (FR) ..... 07 55262

(51) Int. Cl.
*A45D 27/22* (2006.01)

(52) U.S. Cl. ..... 132/295; 132/291; 132/200

(58) Field of Classification Search ..... 132/291, 132/293, 294, 295, 296, 301, 304, 305; 206/581, 206/823
See application file for complete search history.

(56) References Cited

U.S. PATENT DOCUMENTS

| | | | | |
|---|---|---|---|---|
| 1,583,120 | A * | 5/1926 | Brenner | 132/296 |
| 1,626,474 | A | 4/1927 | Morrison | |
| 2,224,995 | A | 12/1940 | Vogel | |
| 2,294,212 | A | 8/1942 | Scharff | |
| 2,309,544 | A | 1/1943 | Scharff | |
| 2,549,643 | A | 4/1951 | Siegal | |
| 2,827,908 | A * | 3/1958 | Lee | 132/291 |
| 3,552,835 | A | 1/1971 | Benzies | |
| 5,437,294 | A | 8/1995 | Ebbets, III et al. | |
| 2005/0199260 | A1 | 9/2005 | Petit | |
| 2007/0108094 | A1 | 5/2007 | Dieudonat | |
| 2007/0204876 | A1 | 9/2007 | Allen et al. | |

FOREIGN PATENT DOCUMENTS

| | | |
|---|---|---|
| DE | 596 137 | 4/1934 |
| EP | 0 614 628 A1 | 9/1994 |
| EP | 1 574 147 A1 | 9/2005 |
| FR | 836 371 | 4/1938 |
| FR | 2 893 236 A1 | 5/2007 |
| GB | 666592 | 2/1952 |
| GB | 2 363 712 A | 1/2002 |
| JP | A 2005-304914 | 11/2005 |
| JP | A 2006-288764 | 10/2006 |

* cited by examiner

*Primary Examiner* — Rachel R Steitz

(74) *Attorney, Agent, or Firm* — Oliff & Berridge, PLC

(57) ABSTRACT

The present invention relates to a makeup compact including a base, a cosmetic, and/or an applicator contained in the base, a support connected to the base via a hinge, a lid that turns relative to the support and a mirror carried by the lid, the lid turning relative to the support in such a manner as to be able to pass from a first configuration to a second configuration and vice versa, after the lid has turned relative to the support, with turning being performed in a single plane, and other than about an axis of rotation that intersects the axis of rotation of the hinge.

25 Claims, 7 Drawing Sheets

MAKEUP COMPACT

This non provisional application claims the benefit of French Applications No. 07 55188 filed on May 22, 2007 and No. 07 55262 filed on May 25, 2007 and U.S. Provisional Application No. 60/944,841 filed on Jun. 19, 2007.

The present invention relates to a makeup compact including a lid that is connected in hinged manner to a base containing at least one cosmetic, and it relates more particularly to a makeup compact in which the lid carries a mirror.

BACKGROUND

The lid is often rectangular in shape. When the short side of the lid is parallel to the hinge that connects it to the base, the compact is easier to handle compared with when it is the long side of the lid that extends parallel to the hinge. However, in the first situation, the mirror carried by the lid can turn out to be too narrow to enable the entire face or both of the eyes to be observed easily, and that can be a hindrance when applying makeup. In the second situation, applying makeup is made easier, but handling the compact is less advantageous, as explained above.

Consequently, there exists a need to make it possible to reconcile the ability to hold the compact in the hand, and to provide a good view of the region being made up.

Publication JP 2005-304914 discloses a plurality of mirrors mounted like a triptych on the lid. A similar solution is adopted in publication GB 2 363 712 and German patent DE 596 137. The use of a plurality of mirrors makes the compact more complex to manufacture and to use.

French patent FR 836 371 describes a compact in which the mirror is mounted in hinged manner on the lid, on the outside thereof, thereby making the compact rather unattractive, and exposing the mirror to increased risk of damage.

Application JP 2006-288764 discloses a compact in which the lid carrying the mirror is hinged relative to the base about a first axis, and can tilt about an axis that is perpendicular to the first. After tilting, the base conceals a portion of the mirror, thereby limiting its advantage.

U.S. Pat. Nos. 2,309,554 and 1 626 474 describe respective compacts in which the mirror is turned about an axis that is parallel to the plane of the mirror.

Application GB 666 592 describes a box including a lid provided with a mirror and connected to a receptacle by means of an arm, the lid having a circularly symmetrical shape.

SUMMARY

The invention seeks to improve makeup compacts still further.

In an aspect of the invention, the makeup compact comprises:

a base;

a cosmetic and/or an applicator contained in the base;

a support connected to the base via a hinge;

a lid that turns relative to the support; and a mirror carried by the lid;

the lid turning relative to the support in such a manner as to be able to pass from a first configuration to a second configuration and vice versa, after the lid has turned relative to the support, with turning being performed in a single plane, and other than about an axis of rotation that intersects the axis of rotation of the hinge.

In particular, turning may be performed through more than 30°, better more than 60°, e.g. through one fourth of a turn, preferably between a portrait configuration and a landscape configuration.

The term "portrait configuration", should be understood to mean that the longitudinal axis of the lid is oriented substantially perpendicularly to the axis of rotation of the hinge, and the term "landscape configuration" should be understood to mean that the longitudinal axis of the lid is oriented substantially parallel to the axis of rotation of the hinge.

By means of the invention, the compact may be made with a shape that is relatively narrow when closed, with its size being only a little greater than the greatest transverse dimension of the mirror, for example, thereby making it easy to handle, while enabling a relatively wide view of the surface that is to be made up, after passing to the landscape configuration, for example.

The lid may be situated on the inside of the support.

The lid carrying the mirror may be tilted in such a manner that in one of the first and second configurations, preferably in the landscape configuration, the center of the lid is spaced apart from the pivot axis connecting the support to the base, by a distance that is greater than or equal to half of the short axis of the lid.

The term "short axis" is used to mean the axis parallel to the short side for a lid that is rectangular, and to mean the greatest transverse dimension for a lid of any other shape. The above distance makes it easier, in the landscape configuration, to use the entire area of the mirror carried by the lid for applying makeup.

The mirror and/or the lid is preferably centered relative to the base in both the first and second configurations.

The lid may be inscribed within the perimeter of the base when the lid is closed in the portrait configuration.

The lid may present a shape that is generally rectangular, but the invention may also apply to lids of other shapes, in particular when the advantage sought is to distance the lid from the hinge once the compact is open.

The lid may present rounded corners, where appropriate.

Moving the lid between the first and second configurations may be performed parallel to the plane of the mirror by appropriately guiding the movement of the lid on the support.

The compact may include a mechanism making it possible to move the lid relative to the support e.g. with a movement other than in pure rotation, between the first and second configurations. The mechanism need not be visible, e.g. because it is situated entirely behind the mirror. The mirror may be situated on the inside of the lid and face the base when the compact is closed. The entire mirror may be visible in both the first and second configurations, since it is not concealed by the base.

By way of example, the movement of the lid relative to the support may be defined by two guides, and by portions in relief, e.g. lugs, that move in or along the guides. One of the guides may be rectilinear. The other guide may be circularly arcuate or a cycloid, for example.

The guides may be arranged such that a corner of the lid moves substantially parallel to the axis of rotation of the hinge. This makes it possible to avoid making an interruption or an indentation in the hinge.

The guides may also be arranged such that a corner of the lid moves away from the axis of the hinge, along a path that is rectilinear or curvilinear.

The lid may also be hinged to the support about a pivot that is stationary relative to the support.

One of the lid and of the support may include a guide that is circularly arcuate, and the other may include a portion in relief, e.g. a lug, that moves in or along the guide. The hinge connecting the support to the base may be interrupted, if necessary, so as to allow a corner of the lid to pass while the lid is turning between the first and second configurations.

The compact may include a resilient or magnetic return member that connects the lid and the support in such a manner as to return the lid into at least one of the first and second configurations.

By way of example, the resilient return member may pass through a state of maximum stress between the first and second configurations, thereby making it possible, for example, to hold the mirror in stable manner, either in its landscape configuration, or in its portrait configuration.

By way of example, the magnetic return member may pass through a state of maximum attraction between the first and second configurations, or through a state of maximum repulsion between the two configurations.

The lid may be longer than the support in the portrait configuration.

The base may include a plurality of housings containing different cosmetics and/or applicators. The cosmetic(s) may comprise at least one makeup composition. The base may receive at least one dish and/or one cake of composition.

In another of its aspects, the invention also provides a method of applying makeup, the method comprising the following steps:

- opening a makeup compact as defined above by pivoting the lid and its support relative to the base;
- passing the lid carrying the mirror from a first configuration, preferably a portrait configuration, to a second configuration, preferably a landscape configuration, by pivoting it relative to the support, parallel to the plane defined by the reflective surface of the mirror, other than about an axis of rotation that intersects the axis of rotation of the support relative to the base;
- applying the makeup; and
- closing the compact, initially by returning the lid into the first configuration, before folding the lid down onto the base.

The invention also provides a makeup compact comprising:

- a base;
- a cosmetic and/or an applicator contained in the base;
- a support connected to the base via a hinge;
- a lid that has a longitudinal axis and that turns relative to the support in such a manner as to be able to pass from a portrait configuration to a landscape configuration and vice versa; and
- a mirror carried by the lid, in particular on the inside thereof.

The compact may present any one of the characteristics defined above.

BRIEF DESCRIPTION OF THE DRAWINGS

The invention can be better understood on reading the following detailed description of non-limiting embodiments thereof, and on examining the accompanying drawings, in which.

MORE DETAILED DESCRIPTION

In all of the figures, the same numerical references are used to designate elements that are identical or similar.

The compact 1 in the embodiment corresponding to FIGS. 1 to 8 includes a base 2 on which a support 3 is hinged about an axis of rotation X.

Figure 5:
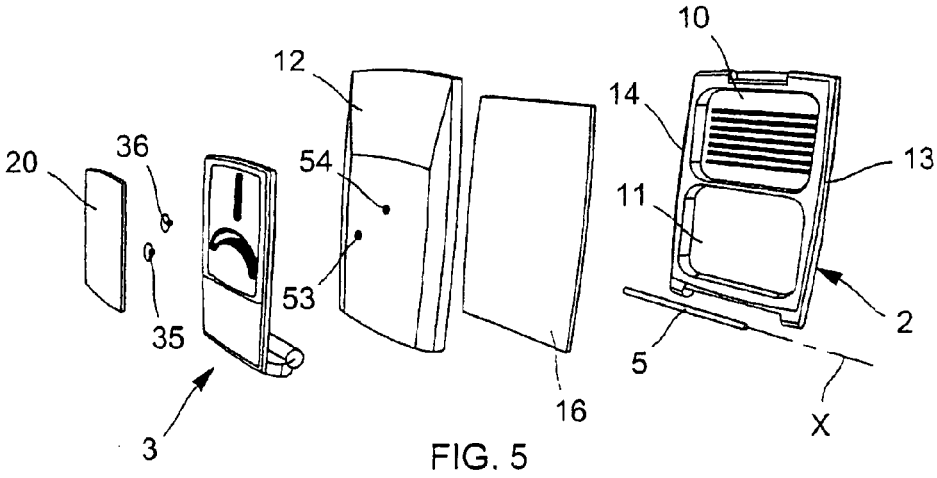
FIG. 5 is an exploded view of the compact in FIGS. 1 to 4.

By way of example, the support 3 is hinged to the base 2 by means of a conventional hinge that includes a pin 5, visible in FIG. 5, but the invention is not limited to a particular way of hinging the support 3 to the base 2, and the hinge could, for example, be a film hinge or a hinge that enables the support to tilt relative to the base, with the assistance of a resilient return member, towards the closed and/or fully open positions.

The support 3 carries a lid 12 that in turn supports a mirror 16 having a reflective face that faces the base 2 when the compact is closed.

The base 2 includes at least one housing 10, in this embodiment two housings 10 and 11, at least one of which receives a cosmetic P, for example, and the other a dish 8 for receiving a second cosmetic, or at least one applicator (not shown), for taking a cosmetic and applying it.

By way of example, the base 2 is made as a single part by molding thermoplastic material. In a variant, the base 2 can be made by assembling a plurality of parts, in particular a body defining the housings 10 and 11 and an outer covering.

In the embodiment shown, the base 2 presents a generally rectangular shape with long sides 13 and 14 that are oriented substantially perpendicularly to the axis of rotation X.

By way of example, the base 2 is twice as long as it is wide, the form factor of the base 2, defined as the ratio of its length to its width, lying in the range 1 to 5, for example.

A clasp 9 can hold the lid 12 in its closed position.

The support can be molded as a single part made of thermoplastic material, or it can comprise a plurality of assembled-together parts.

The hinge connecting the support to the base can comprise portions receiving the pin 5 that are made as single parts respectively with the support and with the base.

The inside of the support 3 preferably carries the lid 12 that can generally be rectangular, the mirror 16 being fastened to the lid 12 by adhesive or by snap-fastening, for example. As shown, the support 3 can include an outer cover 20 that conceals the mechanism hinging the lid 12 to the support 3.

In the embodiment under consideration, the mirror 16 does not move relative to the support 3 in pure rotation, but with a movement that is more complex. By way of example, in the embodiment under consideration, the movement is obtained by means of two guides 50 and 51 that are in the form of slots, the slot 50 that is closer to the axis of rotation X having a curvilinear axis, while the other slot 51 has a rectilinear axis. By way of example, the slots are made through the support 3.

Figure 6:
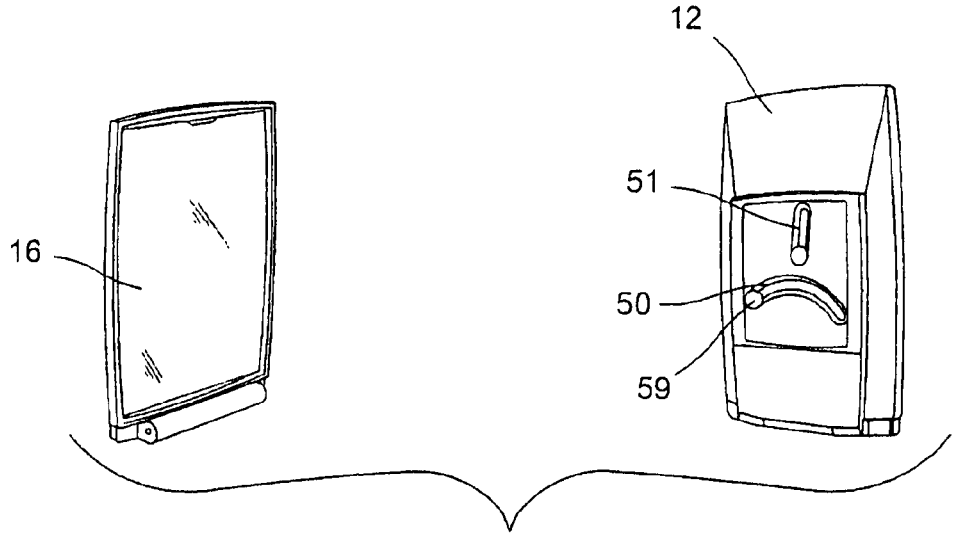
FIGS. 6 to 8 show various configurations of the lid relative to the support that carries it.
Figure 7:
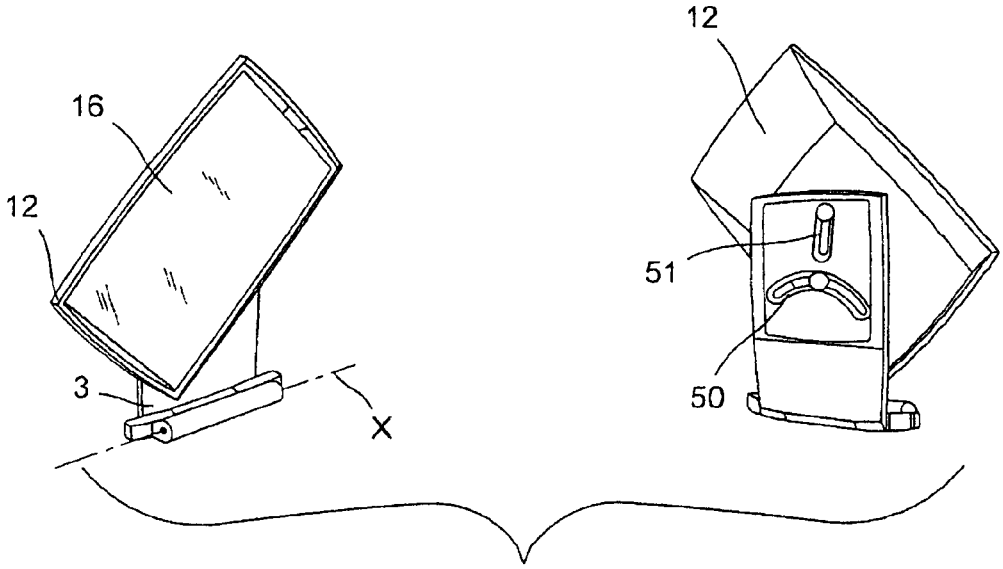
Figure 8:
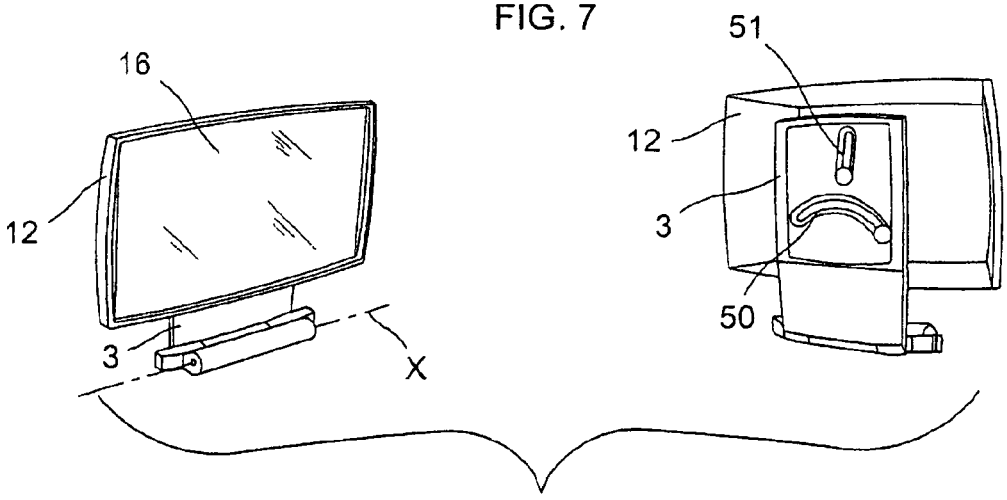

The lid 12 includes two lugs 53 and 54 that move along the guides 50 and 51 respectively, as can be seen in FIGS. 6 to 8, so as to obtain the desired movement of the mirror 16 relative to the support 3.

The lugs 53 and 54 can be held in the corresponding guides by studs 35 and 36 that are fastened to the lugs and that bear on the face of the support that is opposite from the mirror 16. The lugs can be replaced by rivets or by screws, amongst other variants.

The guide 50 can be in the shape of a portion of a cycloid, and the guide 51 can slope upwards and sideways away from the end 59 of the guide 50 where the lug 53 is situated when the mirror is in its portrait configuration, as can be seen in FIG. 6.

Figure 10:
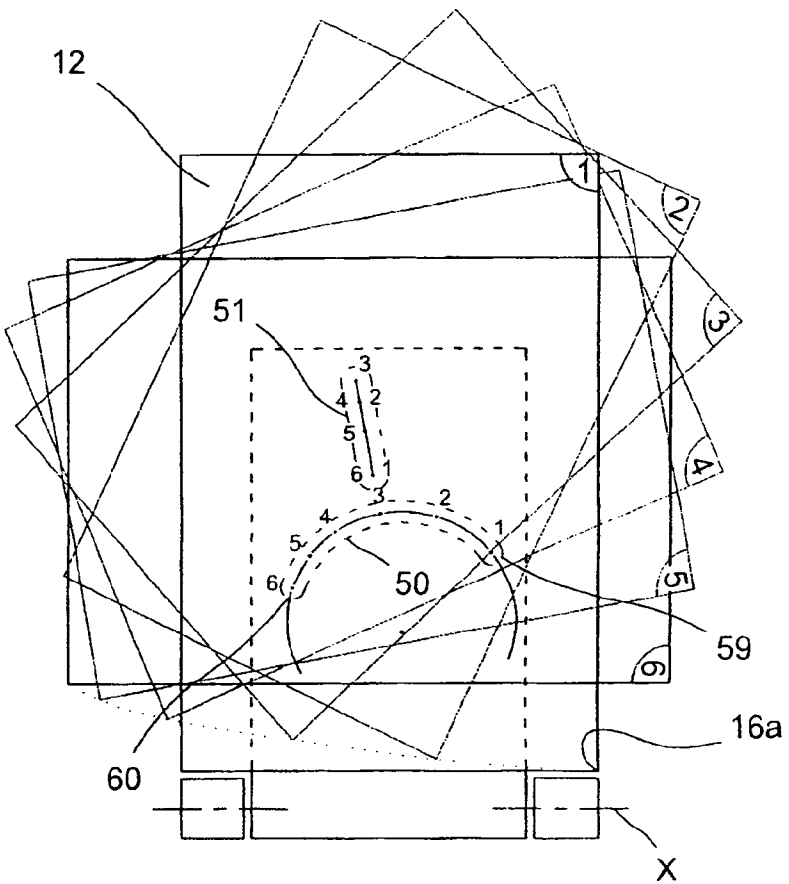
FIGS. 9 to 11 are operating diagrams showing how the movement of the lid relative to the support depends on the shape given to one of the guides.
Figure 9:
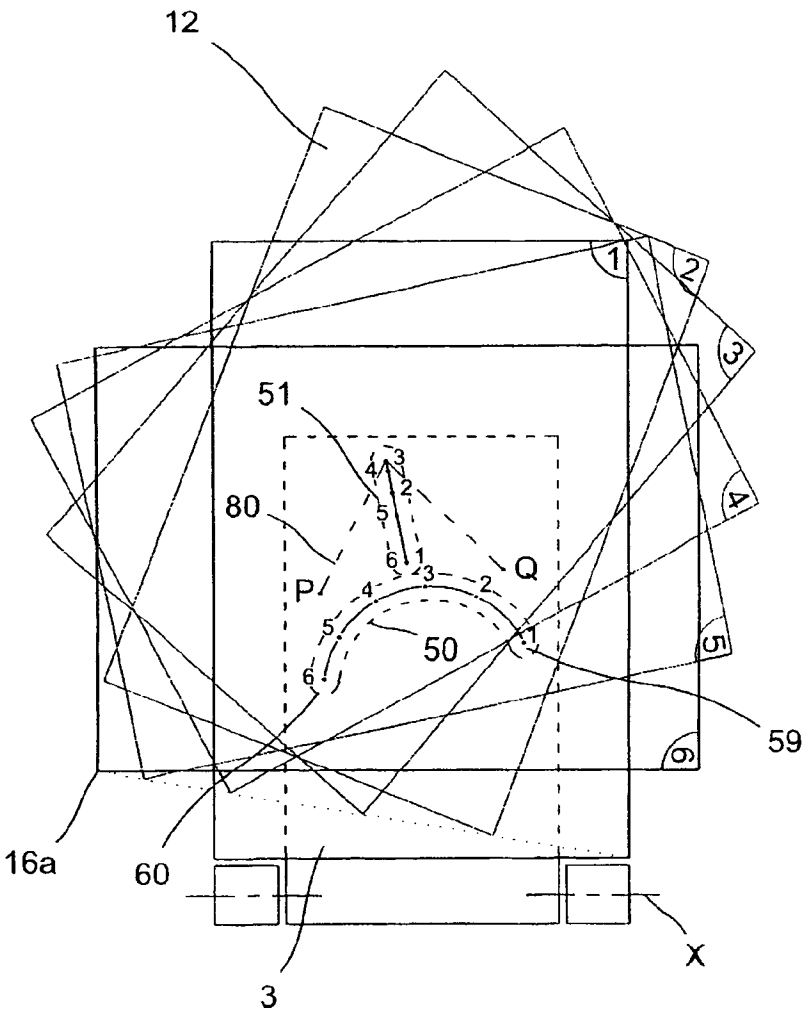
Figure 11:
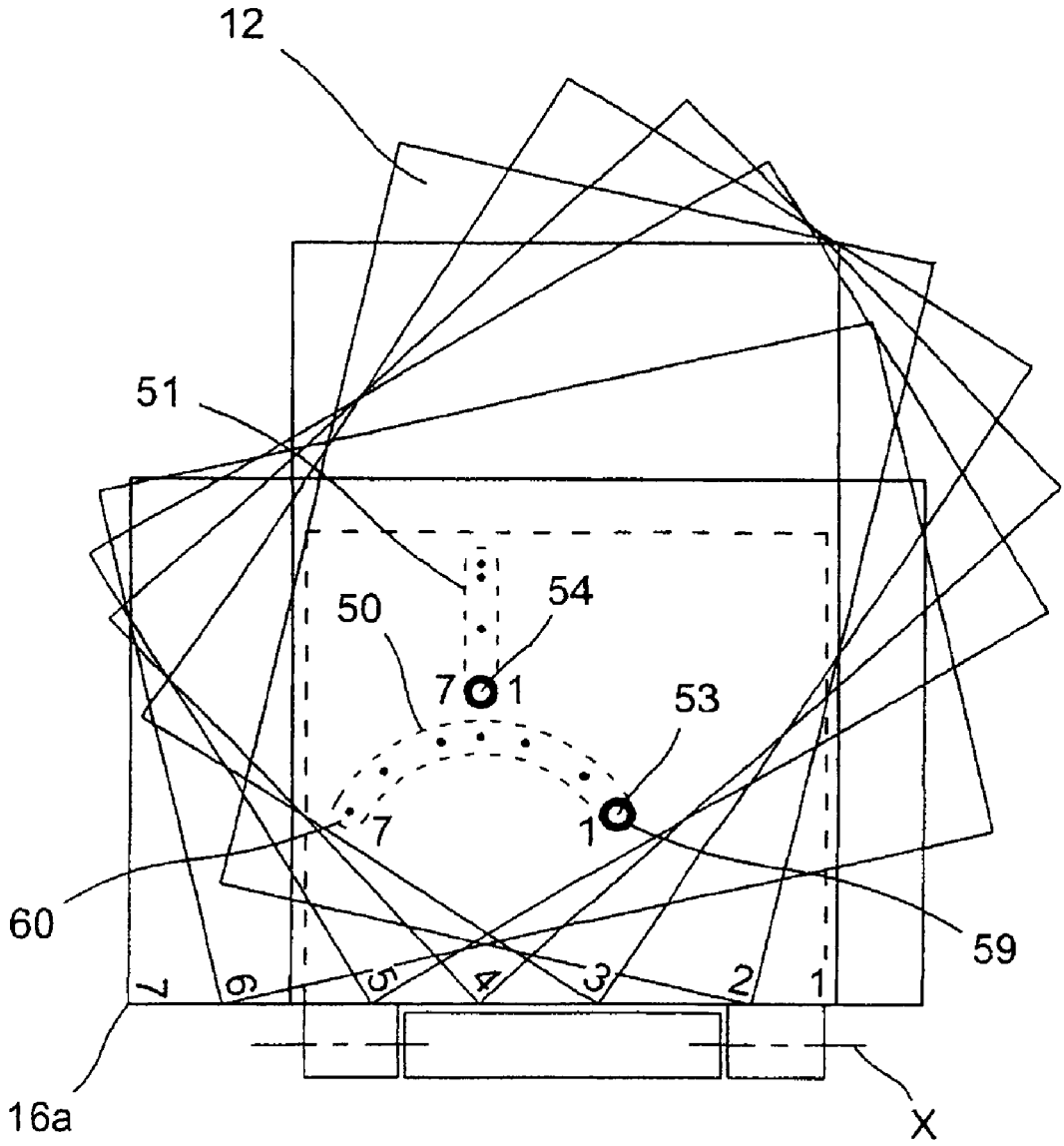

In FIGS. 9 to 11, the index numbers 1 to 6 or 1 to 7 indicate the corresponding positions of the lugs in the guides while the lid moves relative to the support.

A guide having the shape of an arc of a cycloid makes it possible to obtain a linear path for a corner 16*a* of the lid 12. The path can be oblique, with the corner 16*a* moving away from the axis X as it turns, as shown in FIG. 9. The path can also be parallel to the axis X, as shown in FIG. 11. In the embodiment in FIG. 11, the guide 51 extends perpendicularly to the axis X, and its longitudinal axis belongs to a mid-plane of symmetry for the guide 50. On the side remote from the corner 16*a*, the guides 50 and 51 are offset relative to a mid-plane for the lid in its portrait configuration.

The shape of the guide 50 can also be a shape approximating an arc of a cycloid, e.g. an arc of a circle, as shown in FIG. 10.

In this event, the path followed by the corner 16*a* of the lid is not completely rectilinear.

In FIGS. 9 to 11, in the portrait configuration (index number 1), the lug 54 is situated at the bottom end of the guide 51, and the lug 53 is situated at the right-hand end 59 of the guide 50.

While the lid 12 supporting the mirror 16 tilts in the clockwise direction towards its landscape configuration (index number 6 or 7), the lug 54 rises in the guide 51 while the lug 53 moves towards the left-hand end 60 of the guide 50.

After passing through an intermediate position in which the long side of the lid 12 is oriented substantially at 45° relative to the axis of rotation X, the lug 54 descends in the guide 51, while the lug 53 continues to move towards the left-hand end 60 of the guide.

A resilient return member 80 can be disposed in such a manner as to act between the lid and the support and pass, for example, through a state of maximum stress when in the intermediate position (index number 3) in FIG. 9.

By way of example, the resilient return member 80 is an elastically-deformable link or loop that is fastened at two points P and Q on the support 3, as shown in FIG. 9, and the lug 54 of the lid 12 can be arranged to come to bear against the resilient return member in such a manner that said resilient return member passes through a state of maximum stress when the lug 54 is at the top of the guide 51 and is still stressed when the lug 54 is at the bottom of the guide 51.

Such a resilient return member makes it possible to urge the lid 12 both towards its portrait position and towards its landscape position (index numbers 1 and 6 in FIG. 9)

The resilient return member 80 can be made in many other ways, e.g. with a metal pin or a helical spring, or even by means of magnets incorporated in the lid and/or in the support.

Figure 12:
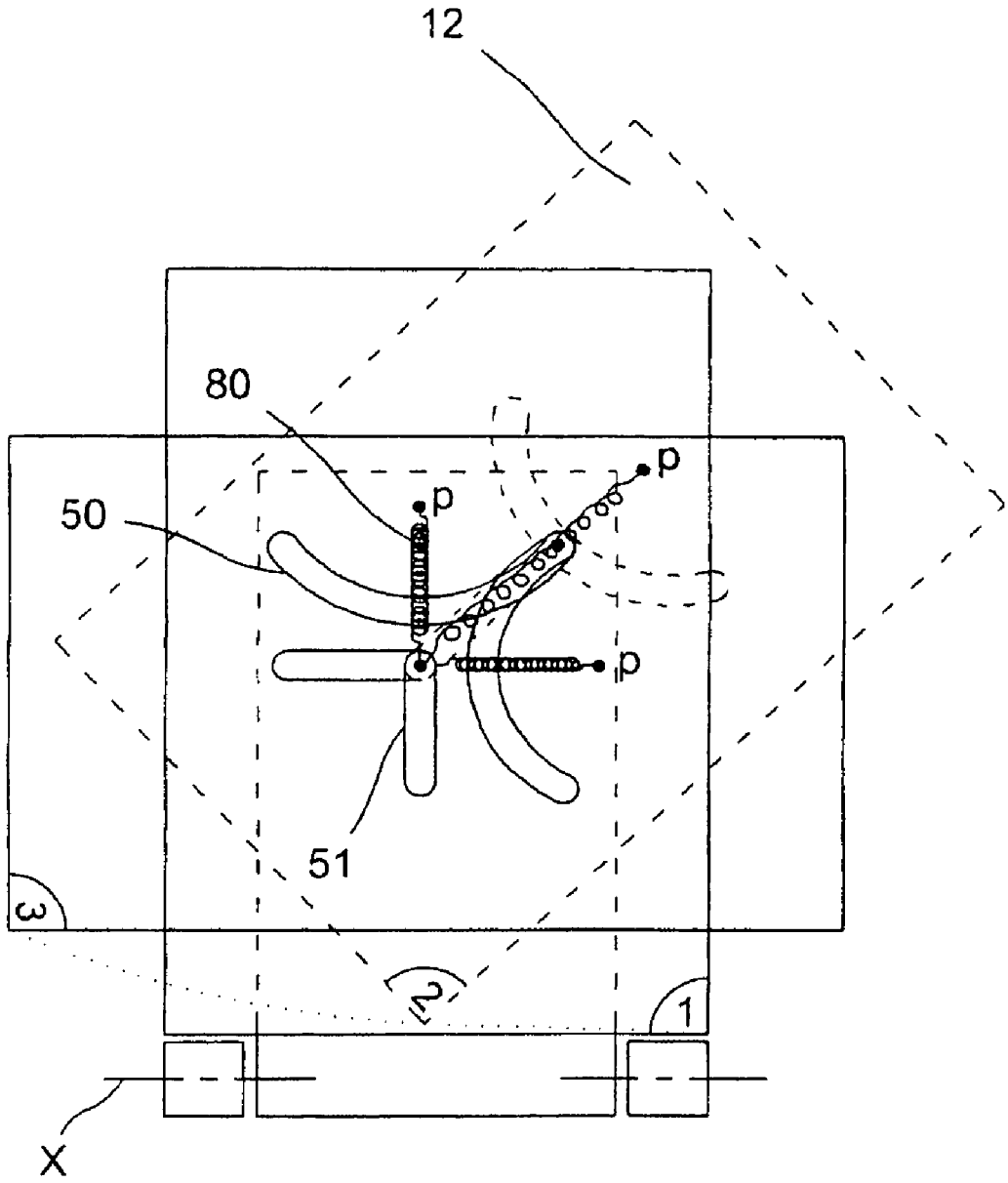
FIG. 12 shows the use of resilient return means.
Figure 13:
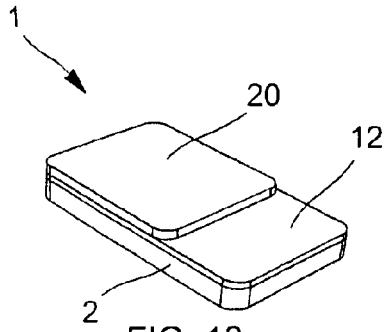
FIGS. 13 to 16 are views similar to FIGS. 1 to 4 showing a variant embodiment of the compact.

FIG. 12 shows the possibility of making the guides 50 and 51 in the lid, and the corresponding lugs 53 and 54 on the support 3.

In this embodiment, the curvilinear guide 50 is further away from the axis X than is the rectilinear guide 51.

In addition, although the guides 50 are concave towards the axis X in the embodiments in FIGS. 9 to 11, in the embodiment in FIG. 12, the guide 50 is convex towards the axis X.

In the variant shown in FIG. 12, the resilient return member is a spring, e.g. a helical spring, that is fastened at one end P to the lid, and at the other end to the lug 54 moving along the guide 51, in such a manner as to be at its maximum tension when the lug 53 moving along the guide 50 is about mid-way along its path.

The embodiment of the compact in FIGS. 13 to 20 differs from the embodiment described above with reference to FIGS. 1 to 12 by the way in which the lid moves relative to the support.

In the embodiment in FIGS. 13 to 20, the lid moves relative to the support 3 in pure rotation.

The support 3 includes a hole 22 in which a lug 25 of the lid 12 is engaged in such a manner as to define a pivot axis Y that is perpendicular to the plane of the mirror 16.

Figure 18:
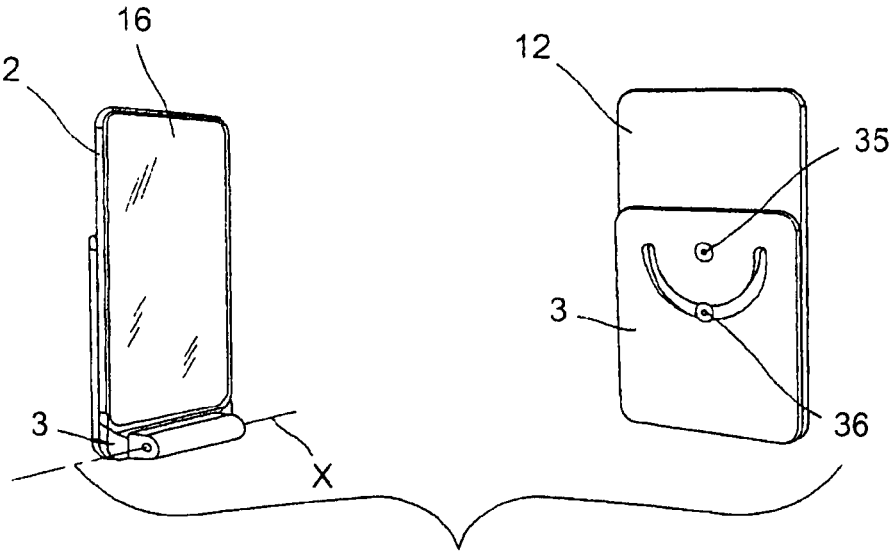
FIGS. 18 to 20 show various configurations of the lid relative to the support of the compact in FIGS. 13 to 17.
Figure 19:
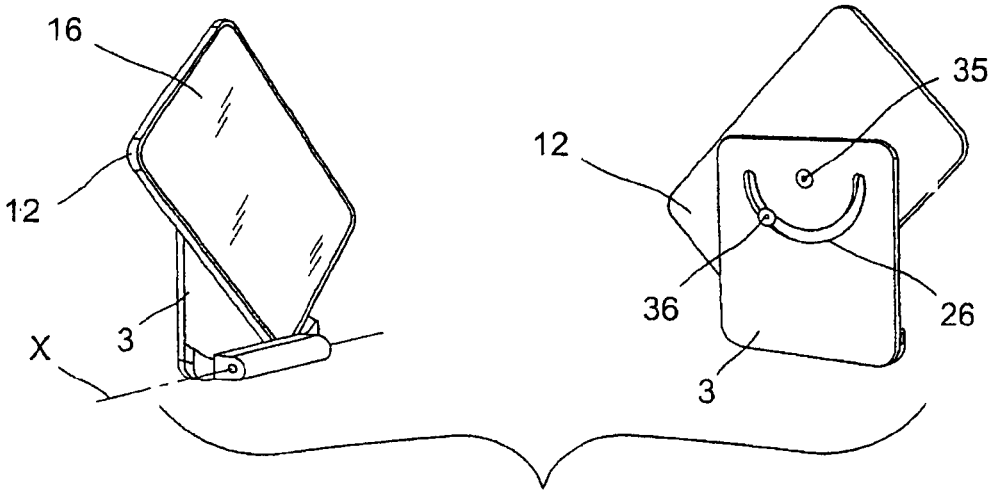
Figure 20:
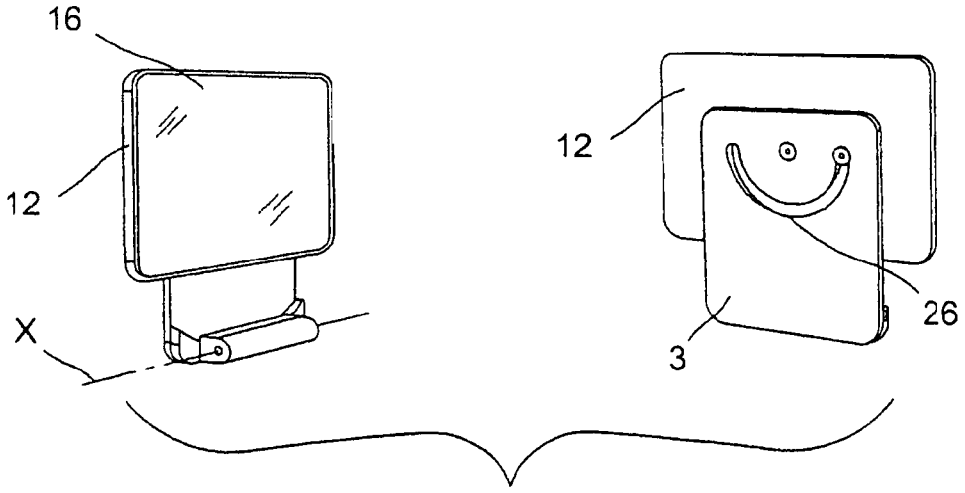

In the embodiment shown, the support 3 also includes a curvilinear guide 26 that extends generally along a semicircle, along which a lug 30 of the lid 12 can move in such a manner as to define two end-of-stroke positions in turning for the lid 12, as shown in FIGS. 18 and 20.

Figure 16:
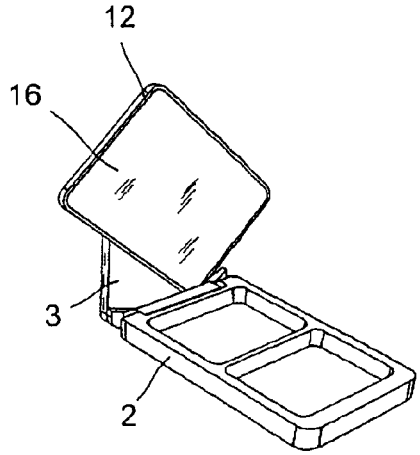
Figure 17:
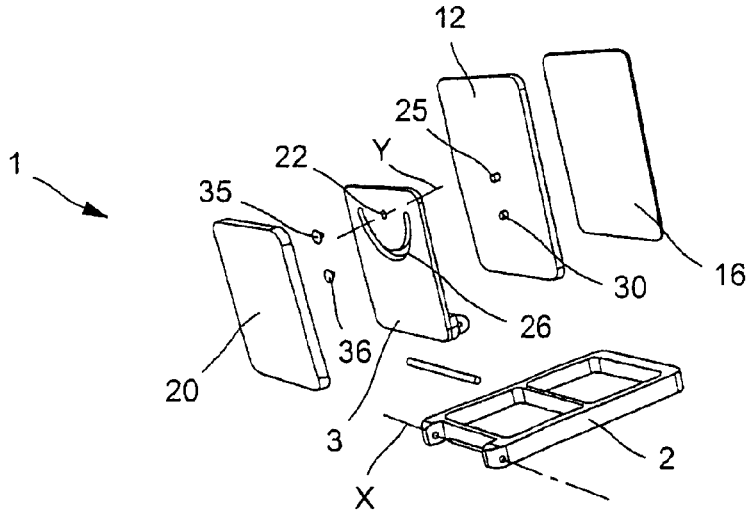
FIG. 17 is a perspective view showing the compact in FIGS. 13 to 16.

The hinge connecting the support 3 to the base 2 is interrupted so as to allow a corner of the lid to pass, as can be seen in particular in FIG. 16.

In a variant, the guide 26 includes, at its ends, notches in which the lug 30 can be snap-fastened, thereby making it possible to lock the mirror both in its portrait configuration and in its landscape configuration.

In order to open the compact, the user pivots the lid and the support about the axis X, after opening the clasp, if any, in order to release the lid 12.

Figure 14:
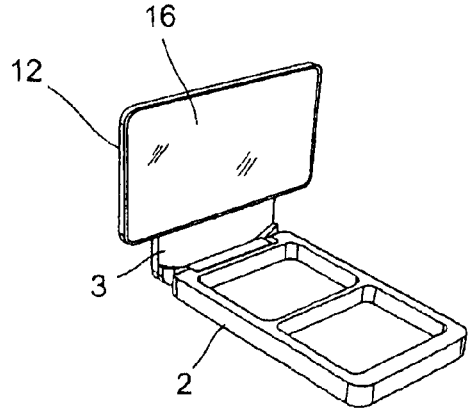
Figure 15:
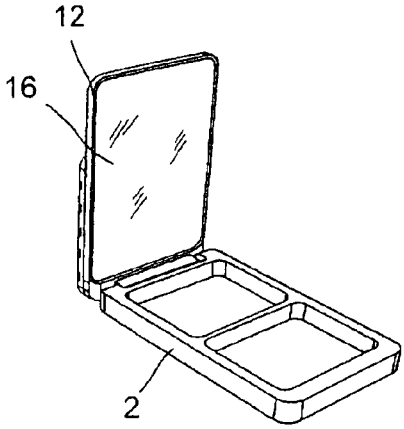

Once the support 3 has been lifted up, the lid 12 carrying the mirror 16 can be moved from its portrait configuration shown in FIG. 15, to its landscape configuration shown in FIG. 14, by tilting through 90° about the axis Y.

By way of example, the mirror is tilted manually by the user, taking the lid 12 with it. The lid can be turned with sufficient braking to ensure that the lid can maintain the position in which it is left by the user. By way of example, braking is obtained by friction between the lugs 25 and 30, the hole 22, and the guide 26.

Figure 1:
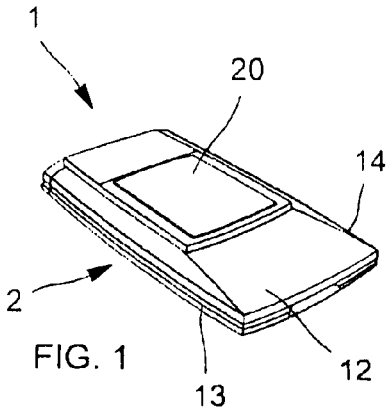
FIGS. 1 to 4 are perspective views showing an embodiment of a compact with various configurations of the lid carrying the mirror relative to the base.
Figure 4:
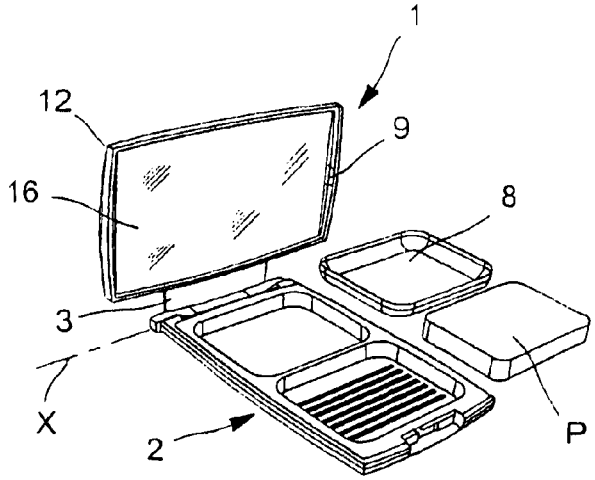
Figure 2:
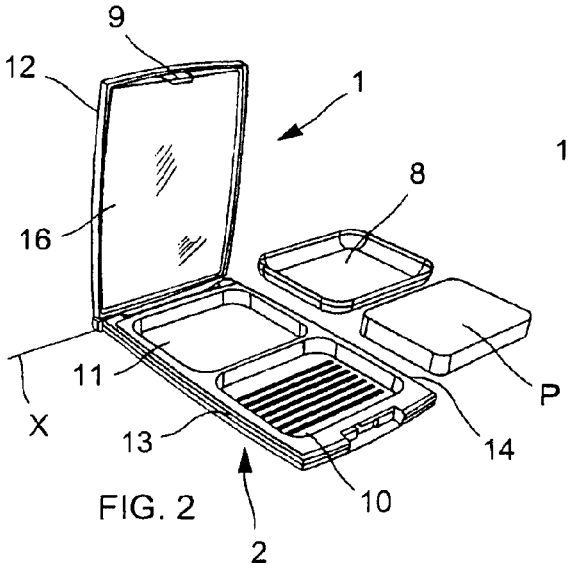
Figure 3:
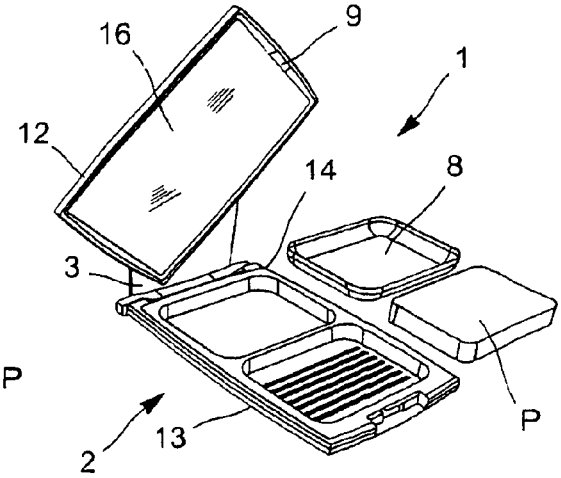

The compact 1 can be used in the landscape configuration in FIG. 4.

After applying makeup, the user can return the lid 12 into its portrait configuration, and can fold the lid down onto the base.

The invention is not limited to the embodiments described above. The base 2 could be made in some other way, e.g. with a single housing.

The compact could include a locking member for locking the lid in its portrait or landscape configurations, e.g. in the form of a tab formed on the support and becoming snap-fastened in a portion in relief of the body of the lid.

The lid could include one guide and one lug, and the support could include the other guide and the other lug.

In the embodiments shown, the support 3 is shorter than the lid 12 carrying the mirror 16, such that the lid, in its landscape configuration, can conceal the support. In variants not shown, the support could be as long, or almost as long, and as wide as the lid.

The lid and the mirror could be made as a single part when the lid is metal plated.

The cover 20 that is fastened on the support 3 in the embodiments shown, could be fastened to the lid in variants not shown, providing room is left to allow the support to pass while the lid is turning.

The lid could present an elongate shape other than rectangular, e.g. it could be oval.

Where appropriate, the compact could include lighting means that could be activated while the lid is passing into its landscape configuration, for example.

The mirror could present a surface that makes it possible to obtain a magnified image, where appropriate.

In the embodiments shown, the lid is tilted in the clockwise direction towards its landscape position. In order to tilt in the anticlockwise direction, the guide mechanism should be positioned symmetrically relative to the right bisector that is perpendicular to the axis X, with the terms left and right being interchanged.

The lid could be tilted relative to the support other than through one fourth of a turn, and it could be tilted between two configurations other than portrait or landscape configurations, for example.

The expression "comprising a" should be understood as being synonymous with "comprising at least one" unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A makeup compact comprising:

a base;

a cosmetic and/or an applicator contained in the base;

a support connected to the base via a hinge having an axis of rotation;

a lid that turns relative to the support; and a mirror carried by the lid, the lid turning relative to the support in such a manner as to be able to pass from a first configuration to a second configuration and vice versa, after the lid has turned relative to the support, with turning being performed in a single plane, and other than about an axis of rotation that intersects the axis of rotation of the hinge, wherein transition from the first configuration to the second is performed by the lid turning through one fourth of a turn relative to the support, the first configuration is a portrait configuration in which a longitudinal axis of the lid is oriented substantially perpendicularly to the axis of rotation of the hinge, and the second configuration is a landscape configuration in which the longitudinal axis of the lid carrying the mirror is oriented substantially parallel to the axis of rotation of the hinge.

2. A compact according to claim 1, the base having a perimeter and the lid being inscribed within the perimeter of the base when the lid is closed in the first configuration.

3. A compact according to claim 1, the lid having a short axis and the lid being tilted in such a manner that in the second configuration, the center of the lid or of the mirror is spaced apart from the pivot axis of the hinge by a distance that is greater than or equal to half of the short axis of the lid.

4. A compact according to claim 1, the lid and/or the mirror being centered relative to the base in both the first and second configurations.

5. A compact according to claim 1, including a mechanism making it possible to move the lid relative to the support, with a movement other than in pure rotation, between the first and second configurations.

6. A compact according to claim 1, the lid carrying the mirror being hinged to the support about a pivot that is stationary relative to the support and to the lid.

7. A compact according to claim 6, one of the support and of the lid including a guide that is circularly arcuate, and the other one of the support and of the lid including a portion in relief that moves in or along the guide.

8. A compact according to claim 6, the hinge connecting the support to the base being interrupted so as to allow a corner of the lid to pass while the lid is turning between the first and second configurations.

9. A compact according to claim 1, the movement of the lid relative to the support being defined by two guides, and by portions in relief that move in or along the guides.

10. A compact according to claim 9, one of the guides being rectilinear.

11. A compact according to claim 9, one of the guides extending along a circular arc or a portion of a cycloid.

12. A compact according to claim 11, the guide extending along a circular arc.

13. A compact according to claim 11, the guide extending along a portion of a cycloid.

14. A compact according to claim 11, the guides being arranged such that a corner of the lid moves substantially parallel to the axis of rotation of the hinge.

15. A compact according to claim 9, the guides being arranged such that a corner of the lid moves away from the axis while passing from the first configuration to the second.

16. A compact according to claim 1, including a return member that is arranged in such a manner as to return the lid carrying the mirror into at least one of the first and second configurations.

17. A compact according to claim 1, including a magnetic return member that acts between the support and the lid.

18. A compact according to claim 17, the return member passing through a state of maximum stress or repulsion between the first and second configurations.

19. A compact according to claim 1, the lid being longer than the support in the portrait configuration.

20. A compact according to claim 1, the base including two or more housings containing different cosmetics.

21. A compact according to claim 1, the mirror being formed by metal-plating the lid.

22. A compact according to claim 1, the cosmetic(s) comprising at least one makeup composition.

23. A method of applying makeup, the method comprising the following steps:

opening a makeup compact as defined in claim 1 by pivoting the support relative to the base;

passing the lid carrying the mirror from the first portrait configuration to the second landscape configuration by turning it relative to the support;

applying the makeup; and closing the compact by returning the lid carrying the mirror into the first portrait configuration, before folding the lid down onto the base.

24. A makeup compact comprising:

a base;

a cosmetic and/or an applicator contained in the base;

a support connected to the base via a hinge having an axis of rotation;

a lid that turns relative to the support; and a mirror carried by the lid, the lid turning relative to the support in such a manner as to be able to pass from a first configuration to a second configuration and vice versa, after the lid has turned relative to the support, with turning being performed in a single plane, and other than about an axis of rotation that intersects the axis of rotation of the hinge, wherein the lid carrying the mirror is hinged to the support about a pivot that is stationary relative to the support and to the lid, one of the support and of the lid including a guide that is circularly arcuate, and the other one of the support and of the lid including a portion in relief that moves in or along the guide.

25. A makeup compact comprising:

a base;

a cosmetic and/or an applicator contained in the base;

a support connected to the base via a hinge having an axis of rotation;

a lid that turns relative to the support; and a mirror carried by the lid, the lid turning relative to the support in such a manner as to be able to pass from a first configuration to a second configuration and vice versa, after the lid has turned relative to the support, with turning being performed in a single plane, and other than about an axis of rotation that intersects the axis of rotation of the hinge, wherein the movement of the lid relative to the support is defined by two guides, and by portions in relief that move in or along the guides.

* * * * *